US012773025B2

(12) United States Patent
Nagaike

(10) Patent No.: US 12,773,025 B2
(45) Date of Patent: Oct. 27, 2026

(54) INNER GLOVE

(71) Applicant: KOBAYASHI PHARMACEUTICAL CO., LTD., Osaka (JP)

(72) Inventor: Daisaku Nagaike, Dalton, GA (US)

(73) Assignee: KOBAYASHI PHARMACEUTICAL CO., LTD., Osaka (JP)

( * ) Notice: Subject to any disclaimer, the term of this patent is extended or adjusted under 35 U.S.C. 154(b) by 0 days.

(21) Appl. No.: 18/496,163

(22) Filed: Oct. 27, 2023

(65) Prior Publication Data

US 2025/0134189 A1 May 1, 2025

(51) Int. Cl.

| | |
|---|---|
| ***A41D 19/00*** | (2006.01) |
| ***D02G 3/04*** | (2006.01) |
| ***D02G 3/36*** | (2006.01) |
| ***D02G 3/44*** | (2006.01) |
| ***D04B 1/16*** | (2006.01) |
| ***D04B 1/28*** | (2006.01) |

(52) U.S. Cl.

CPC ..... *A41D 19/0013* (2013.01); *A41D 19/0006* (2013.01); *A41D 19/0037* (2013.01); *D02G 3/045* (2013.01); *D02G 3/36* (2013.01); *D02G 3/44* (2013.01); *D04B 1/16* (2013.01); *D04B 1/28* (2013.01); *A41D 2500/10* (2013.01); *D10B 2331/02* (2013.01); *D10B 2331/10* (2013.01); *D10B 2501/041* (2013.01)

(58) Field of Classification Search

CPC ..... A41D 19/0013; A41D 19/0006; A41D 19/0037; D02G 3/045; D02G 3/36; D02G 3/44; D04B 1/16; D04B 1/28

See application file for complete search history.

(56) References Cited

U.S. PATENT DOCUMENTS

| | | | | | |
|---|---|---|---|---|---|
| 3,540,204 | A * | 11/1970 | Matsubara | D02G 3/324 | 57/328 |
| 5,810,753 | A * | 9/1998 | Eberbach | A61F 5/0118 | 602/20 |
| 6,141,801 | A * | 11/2000 | Helenick | A61F 7/02 | 2/160 |
| 2009/0125086 | A1 * | 5/2009 | Juta | A61F 7/03 | 607/108 |

(Continued)

FOREIGN PATENT DOCUMENTS

| | | | |
|---|---|---|---|
| JP | H09-228124 | A | 9/1997 |
| JP | 2000-064110 | A | 2/2000 |
| JP | 2003-064513 | A | 3/2003 |

(Continued)

OTHER PUBLICATIONS

International Search Report for PCT Application No. PCT/JP2024/038080 dated Dec. 24, 2024, (in 10 pages).

*Primary Examiner* — Uyen T Nguyen

(74) *Attorney, Agent, or Firm* — Knobbe, Martens, Olson & Bear, LLP

(57) ABSTRACT

An inner glove configured such that a chemical warmer is attachable in a position facing the back of a hand. The inner glove is configured for wearing under an outer glove, wherein the inner glove includes a body portion that is seamless in a circumferential direction of the hand, the body portion includes an opening in which a wrist may be inserted, an opening in which a thumb may be inserted, and at least two openings in which fingers other than the thumb may be inserted.

7 Claims, 3 Drawing Sheets

(56) References Cited

U.S. PATENT DOCUMENTS

2016/0287970 A1* 10/2016 Charles ..... A41D 19/002

FOREIGN PATENT DOCUMENTS

| | | | |
|---|---|---|---|
| JP | 2005-307415 | A | 11/2005 |
| JP | 2007-014792 | A | 1/2007 |
| JP | 2008-061987 | A | 3/2008 |
| JP | 2012-162813 | A | 8/2012 |
| JP | 2021-025153 | A | 2/2021 |

* cited by examiner

INNER GLOVE

TECHNICAL FIELD

The present disclosure relates to an inner glove for wearing under an outer glove, which is configured such that a chemical warmer is attachable in a position facing the back of a hand.

BACKGROUND ART

Gloves mainly used to protect the hands (also referred to as outer gloves), which are used in various work (such as work in mining, agriculture, forestry and fisheries, civil engineering and construction, manufacturing, medical care, and cleaning), as well as outdoor sports and activities (such as motorcycling, cycling, golf, skiing, snowboarding, snowmobiling, skating, mountain climbing, hiking, trekking, camping, and fishing), have suffered from poor breathability, which makes the inside of the glove sticky due to sweating when worn, causing discomfort or reduces the wearing comfort.

To solve this drawback, inner gloves for wearing under an outer glove have been proposed (see, for example, Patent Literatures 1 to 3).

Another drawback is that although known outer gloves have a heat retention function, they do not have a heat generation function, and thus, the temperature of the hands easily drops during outdoor sports and activities or during indoor or outdoor work in cold regions or periods, which hinders the user from fully utilizing the hand functions.

The drop in the temperature of the hands can be prevented to some extent, by wearing an inner glove under an outer glove. Unfortunately, because the inner glove also does not have a heat generation function although it has a heat retention function, the inner glove cannot be considered as being sufficiently effective in preventing a drop in the temperature of the hands.

Chemical warmers are known as having a heat generation function as well as being compact and portable. One possible solution to prevent the drop in the temperature of the hands may be inserting a chemical warmer between the outer glove and the inner glove. Unfortunately, this causes the chemical warmer to easily move out of position due to hand movements, which hinders hand movements or reduces the wearing comfort.

As one example using a chemical warmer with a heat generation function, Patent Literature 4 has proposed a thermotherapy device for wearing on a wrist, having a tubular holder made of a stretchable material and a chemical warmer held in the holder, wherein the holder includes a wrist region and a palm-and-back region of hand, and the holder has a housing portion in the wrist region, the housing portion allowing insertion and removal of the chemical warmer or attachment of the chemical warmer.

Unfortunately, the thermotherapy device for wearing on a wrist disclosed in Patent Literature 4 is not an inner glove for wearing under an outer glove, and has the feature that the chemical warmer is attached in the wrist region.

CITATION LIST

Patent Literature

Patent Literature 1: JP-A-2000-64110
Patent Literature 2: JP-A-2003-64513

Patent Literature 3: JP-A-2012-162813
Patent Literature 4: JP-A-2007-14792

SUMMARY OF INVENTION

Technical Problem

An object of the present disclosure is to provide an inner glove configured such that a chemical warmer is attachable in a position facing the back of a hand.

Solution to Problem

The present disclosure relates to an inner glove for wearing under an outer glove,

- wherein the inner glove includes a body portion that is seamless in a circumferential direction of a hand,
- the body portion includes an opening in which a wrist is inserted, an opening in which a thumb is inserted, and at least two openings in which fingers other than the thumb are inserted,
- the body portion has a multilayer structure including an inner fabric and an outer fabric,
- the inner fabric and the outer fabric are made of a stretchable material,
- the outer fabric includes an opening portion allowing insertion and removal of a chemical warmer, in a position facing the back of the hand, and
- the body portion is configured such that the chemical warmer is attachable in the position facing the back of the hand, between the inner fabric and the outer fabric.

In one embodiment of the inner glove, preferably, the body portion includes two openings in which fingers other than the thumb are inserted.

In one embodiment of the inner glove, preferably, the two openings in which fingers other than the thumb are inserted are an opening in which an index finger and a middle finger are inserted and an opening in which a ring finger and a little finger are inserted.

In one embodiment of the inner glove, preferably, the body portion includes four openings in which fingers other than the thumb are inserted.

In one embodiment of the inner glove, preferably, the body portion includes two openings in which thumbs are inserted, and the inner glove is an inner glove for left and right hands.

In one embodiment of the inner glove, preferably, the body portion has a two-layer structure formed of the inner fabric and the outer fabric.

In one embodiment of the inner glove, preferably, the stretchable material is a covered yarn containing a polyurethane elastic yarn as a core yarn and a polyamide yarn as a sheath yarn.

In one embodiment of the inner glove, preferably, the inner glove further includes a resiliently stretchable cuff joined to the body portion, wherein the resiliently stretchable cuff is configured to hold and prevent a wrist side of the body portion from curling up.

Advantageous Effects of Invention

In the inner glove of the present disclosure, the outer fabric of the body portion includes an opening portion allowing insertion and removal of a chemical warmer, in the position facing the back of the hand, and thus, by inserting the chemical warmer between the inner fabric and the outer fabric through the opening portion, the chemical warmer can be easily attached in the position facing the back of the hand to effectively prevent a drop in the temperature of the hand through its heat generation function. Also, the inner glove of the present disclosure is made of a highly stretchable material, and thus achieves not only a good fit regardless of hand size with little or no discomfort due to pressure, but also a tightening effect, which makes it less likely for the chemical warmer inserted between the inner fabric and the outer fabric to move out of position, allowing the chemical warmer to be held in the position facing the back of the hand. Moreover, the inner glove of the present disclosure is seamless in the circumferential direction of the hand and free of sewn seams, and thus achieves excellent wearing comfort when worn under an outer glove. Furthermore, the inner glove of the present disclosure is configured such that the chemical warmer is attachable between the inner fabric and the outer fabric, and thus, the chemical warmer does not directly contact the back of the hand, and is evenly and moderately pressed against the back of the hand, without being strongly pressed against local portions, such that a burn can be prevented. Moreover, the inner glove of the present disclosure is a fingerless glove that does not cover the five fingers and can be manufactured using a tubular fabric, and thus has the advantage of being very easy to manufacture and being manufacturable at a low cost. Furthermore, the inner glove of the present disclosure is extremely thin and can follow changes in the shape of the hand, and thus matches any type of outer glove and has the advantage of being usable in combination with a desired outer glove.

DESCRIPTION OF EMBODIMENTS

As used herein, the term "X to Y" regarding a numerical range refers to X or more and Y or less.

As used herein, "inner glove" means a glove for wearing under an outer glove.

As used herein, "outer glove" means a glove for wearing on the outermost side.

As used herein, "chemical warmer", also referred to as "heat pad", "hand warmer", or "disposable heating pac", means an article in which an exothermic composition containing an oxidizable metal is contained in a breathable housing, which article utilizes a heat generation mechanism by which the oxidizable metal generates oxidation heat upon contact with oxygen.

The inner glove of the present disclosure is an inner glove for wearing under an outer glove, wherein the inner glove includes a body portion that is seamless in a circumferential direction of a hand, the body portion includes an opening in which a wrist is inserted, an opening in which a thumb is inserted, and at least two openings in which fingers other than the thumb are inserted, the body portion has a multilayer structure including an inner fabric and an outer fabric, the inner fabric and the outer fabric are made of a stretchable material, the outer fabric includes an opening portion allowing insertion and removal of a chemical warmer, in a position facing the back of the hand, and the body portion is configured such that the chemical warmer is attachable in the position facing the back of the hand, between the inner fabric and the outer fabric.

Preferred embodiments of the inner glove of the present disclosure are now described with FIGS. 1 to 5; however, the inner glove of the present disclosure is not limited to these embodiments, and various modifications can be made thereto.

Figure 1:
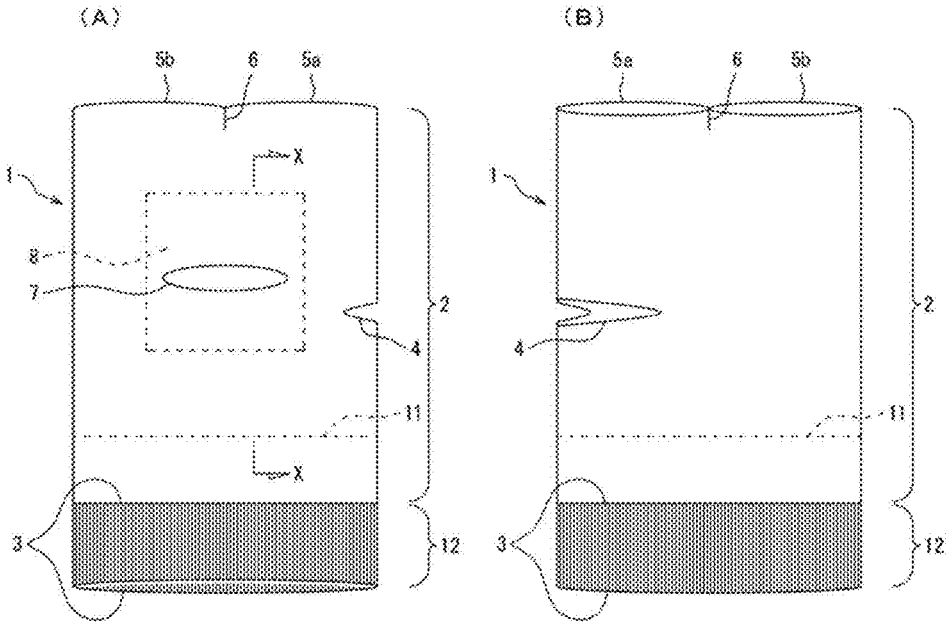
FIG. 1(A) is a schematic diagram of the back side of the inner glove (for a left hand) of the present disclosure.
FIG. 1(B) is a schematic diagram of the palm side of the inner glove (for a left hand) of the present disclosure.
Figure 3:
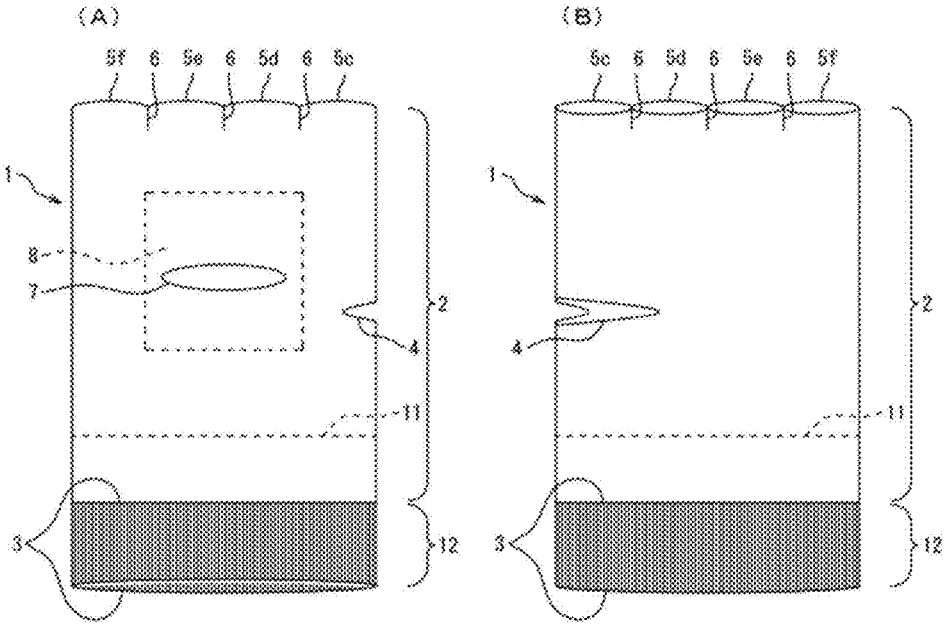
FIG. 3(A) is a schematic diagram of still another embodiment of the back side of the inner glove (for a left hand) of the present disclosure.
FIG. 3(B) is a schematic diagram of still another embodiment of the palm side of the inner glove (for a left hand) of the present disclosure.
Figure 4:
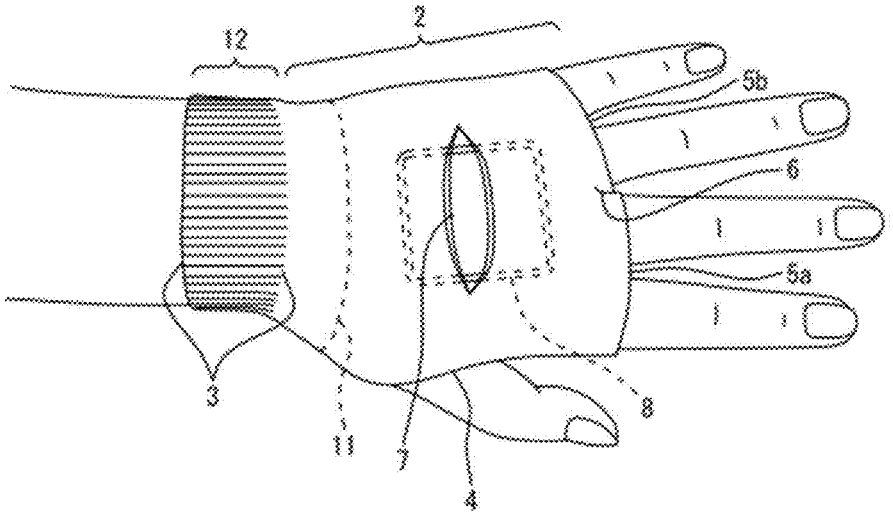
FIG. 4 is a schematic diagram of the inner glove shown in FIG. 1 when worn on a left hand.
Figure 5:
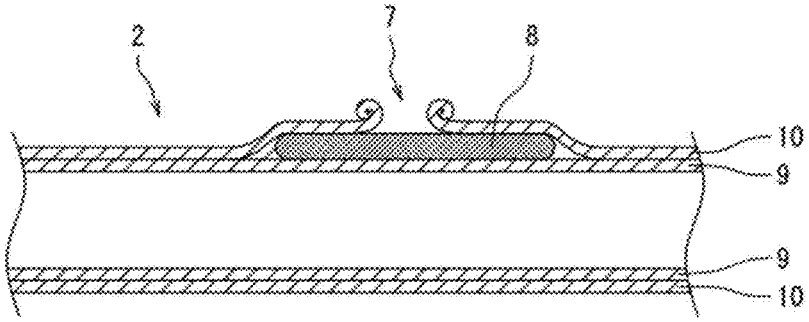
FIG. 5 is a cross-sectional view along the line X-X in FIG. 1.

FIG. 1(A) is a schematic diagram of the back side of the inner glove (for a left hand) of the present disclosure, and FIG. 1(B) is a schematic diagram of the palm side of the inner glove (for a left hand) of the present disclosure. FIG. 2(A) is a schematic diagram of another embodiment of the back side of the inner glove (for left and right hands) of the present disclosure, and FIG. 2(B) is a schematic diagram of another embodiment of the palm side of the inner glove (for left and right hands) of the present disclosure. FIG. 3(A) is a schematic diagram of still another embodiment of the back side of the inner glove (for a left hand) of the present disclosure, and FIG. 3(B) is a schematic diagram of still another embodiment of the palm side of the inner glove (for a left hand) of the present disclosure. FIG. 4 is a schematic diagram of the inner glove shown in FIG. 1 when worn on a left hand. FIG. 5 is a cross-sectional view along the line X-X in FIG. 1.

An inner glove 1 of the present disclosure includes at least a body portion 2 that is seamless in a circumferential direction of a hand.

While the length (axial direction) and width (direction perpendicular to the axis) of the body portion 2 are not specifically limited, typically, the length is about 10 to 18 cm and the width is about 8 to 10 cm when the inner glove 1 is placed flat. While the thickness of the fabric of the body portion 2 (multilayer structure including an inner fabric and an outer fabric) is not specifically limited, typically, the thickness is about 0.3 to 1.3 mm, and is preferably 0.5 to 1.1 mm, more preferably 0.7 to 0.9 mm, in order to prevent a tight feeling and discomfort.

The body portion 2 includes an opening 3 in which a wrist is inserted, an opening 4 in which a thumb is inserted, and at least two openings 5 in which fingers other than the thumb are inserted. The body portion 2 has a tubular overall shape, and more specifically, has a structure in which a partial joint is formed at one circumferential end of the tubular body (see FIGS. 1 to 4).

Figure 2:
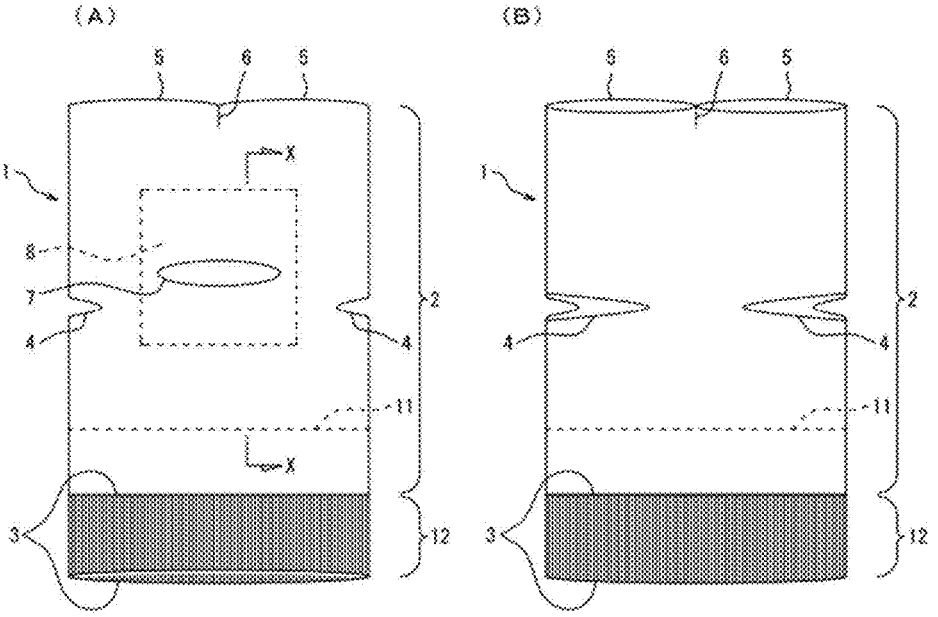
FIG. 2(A) is a schematic diagram of another embodiment of the back side of the inner glove (for left and right hands) of the present disclosure.
FIG. 2(B) is a schematic diagram of another embodiment of the palm side of the inner glove (for left and right hands) of the present disclosure.

The opening 4 is an opening in which the thumb of a left or right hand is inserted. FIG. 1 shows the opening 4 as an opening in which the thumb of a left hand is inserted. As shown in FIG. 2, two openings 4 may be provided for use as an inner glove for left and right hands. The number, size, shape, and positions of the openings 4 are not specifically limited, and may be appropriately designed and adjusted in consideration of ease of insertion of the thumb, wearing comfort, design, and the like.

The openings 5 are openings in which fingers other than the thumb are inserted. FIG. 1 shows an opening 5*a* in which an index finger and a middle finger are inserted and an opening 5*b* in which a ring finger and a little finger are inserted. A joint portion 6 is formed to join the back-side fabric and the palm-side fabric to form the openings 5. The joint portion 6 also serves as a stopper to prevent the body portion 2 from being inserted unnecessarily to the wrist side when the inner glove 1 is worn on a hand. The shape of the joint portion 6 is not specifically limited and may be, for example, a dot shape, a straight shape, a curved shape, or a V shape, preferably a straight shape. The size of the joint portion 6 is also not specifically limited; for example, when the joint portion 6 has a straight shape, the length is typically about 6 to 12 mm, preferably 8 to 10 mm, and more preferably 7 to 9 mm. When two openings 5 are provided, an embodiment other than that shown in FIG. 1 may be adopted, wherein the two openings 5 are an opening in which an index finger is inserted and an opening in which a middle finger, a ring finger, and a little finger are inserted, or the two openings 5 are an opening in which an index finger, a middle finger, and a ring finger are inserted and an opening in which a little finger is inserted. Alternatively, three openings 5 may be provided; in this case, it may be appropriately determined which fingers should be inserted in which openings, in consideration of the design and the like. When three openings 5 are provided, two joint portions 6 are provided. Alternatively, as shown in FIG. 3, four openings 5 may be provided, which are an opening 5*c* in which an index finger is inserted, an opening 5*d* in which a middle finger is inserted, an opening 5*e* in which a ring finger is inserted, and an opening 5*f* in which a little finger is inserted. When four openings 5 are provided, three joint portions 6 are provided. The number of openings 5 to be provided is preferably two, i.e., an opening in which index and middle fingers are inserted and an opening in which ring and little fingers are inserted.

The body portion 2 may have a width that is substantially equal from the opening 3 side to the opening 5 side, as shown in FIG. 1. Alternatively, the body portion 2 may be wider on the opening 5 side than on the opening 3 side, for an individual with large hands.

The body portion 2 has a multilayer structure including an inner fabric and an outer fabric made of a stretchable material. The body portion 2 may have a two-layer structure formed of the inner fabric and the outer fabric, or a multilayer structure of three or more layers including, in addition to the inner and outer fabrics, one or more additional fabrics laminated inside the outer fabric. The body portion 2 preferably has a two-layer structure formed of the inner fabric and the outer fabric, in view of reducing the thickness. Examples of the fabric forming the body portion 2 include woven fabrics, knitted fabrics, and nonwoven fabrics, with knitted fabrics being preferred.

In the body portion 2, the outer fabric includes an opening portion 7 allowing insertion and removal of a chemical warmer 8, in a position facing the back of the hand. The shape, size, and position of the opening portion 7 are not specifically limited as long as the opening portion 7 is formed in the position facing the back of the hand. The opening portion 7 preferably has an oval or circular shape. When the opening portion 7 has an oval or circular shape, it has a major diameter or a diameter of, for example, about 1 to 4 cm, preferably 1.5 to 3.5 cm. Even if the chemical warmer 8 is larger in width (such as major diameter or diameter) than the opening portion 7, the outer fabric is made of a stretchable material, such that the chemical warmer 8 can be easily inserted and removed by enlarging the opening portion 7. When the body portion 2 is longitudinally divided into three equal sections, i.e., a wrist-side section, a central section, and a finger-side section, the opening portion 7 may be formed in any of the wrist-side, central, and finger-side sections, preferably in the central section in view of facilitating insertion and removal of the chemical warmer 8.

The body portion 2 is formed of a stretchable material. The stretchable material is not specifically limited and may be formed using a single fiber or two or more fibers from, for example, synthetic fibers (such as polyamide fibers, polyurethane fibers, and polyester fibers) and blended fibers of synthetic and natural fibers (such as plant fibers, animal fibers, and mineral fibers). The stretchable material may be selected appropriately in consideration of stretchability, wearing comfort, thermal conductivity, workability, abrasion resistance, chemical resistance, and the like. The material forming the body portion 2 is preferably formed using a combination of a polyamide fiber and a polyurethane elastic fiber, more preferably a covered yarn containing a polyurethane elastic yarn as a core yarn and a polyamide yarn as a sheath yarn, in view of achieving excellent stretchability for a good fit regardless of hand size, as well as achieving excellent wearing comfort. The covered yarn may be a single covered yarn or a double covered yarn. The polyamide forming the polyamide yarn is not specifically limited, and examples include nylon 6, nylon 66, nylon 12, and nylon 610. Each of the core yarn and the sheath yarn may be a monofilament or a multifilament. While the ratio between the polyamide fiber (polyamide yarn) and the polyurethane elastic fiber (polyurethane elastic yarn) is not specifically limited, when the total content of both fibers is defined as 100% by weight, preferably, the content of the polyamide fiber is 85 to 95% by weight and the content of the polyurethane elastic fiber is 5 to 15% by weight; and more preferably, the content of the polyamide fiber is 90 to 95% by weight and the content of the polyurethane elastic fiber is 5 to 10% by weight, in view of achieving excellent stretchability and wearing comfort.

The body portion 2 typically has an elongation of about 8 to 50%. In view of achieving excellent stretchability for a good fit regardless of hand size, the body portion 2 preferably has an elongation of 10 to 40%, more preferably 15 to 30%. As used herein, the elongation of the body portion 2 is a value measured using the following method. A sample is obtained first by cutting the outer fabric into a ring shape with a width of 2 cm (axial direction), in a region at least 2 cm toward the inner side from both ends of the body portion 2 and not having the opening 4 in which the thumb is inserted and the opening portion 7 allowing insertion and removal of the chemical warmer. The sample is placed flat, and maximum length $L_0$ of the sample is measured with a ruler. Then, one end of the ring-shaped sample is hooked on a suspended S-hook, with a 50 g weight suspended on the other end of the ring-shaped sample, and maximum length Li of the sample after elongation is measured with a ruler. Then, the elongation of the body portion 2 is calculated using the following equation:

$$\text{Elongation (\%)} = \{(L_1 - L_0)/L_0\} \times 100$$

The method for producing the body portion 2 is not specifically limited and may be, for example, as follows: A multilayer structure including an inner fabric and an outer fabric is obtained first by folding, in the axial direction, a tubular seamless fabric produced using a circular knitting machine, or by laminating two or more sheets of the tubular seamless fabric to form a tubular shape. The opening 4 in which the thumb is inserted, and the opening portion 7 allowing insertion and removal of the chemical warmer 8, which is formed in the outer fabric, are formed during knitting of the tubular seamless fabric. Then, at least one joint portion 6 is formed by sewing, for example, to form at least two openings 5 in which fingers other than the thumb are inserted. While the knit structure of the seamless fabric is not specifically limited, it is preferably a mesh knit, in view of achieving good breathability. Preferably, as shown in FIGS. 1 to 3, a connection portion 11 is formed on the wrist side of the body portion 2, by connecting the laminated fabrics by sewing, for example, to prevent the outer fabric and the like from curling up.

As shown in FIG. 5, for example, the opening portion 7 is formed by leaving the outer fabric 10 partially open during knitting, in the body portion 2 having a two-layer structure formed of the inner fabric 9 and the outer fabric 10. Then, by inserting the chemical warmer 8 between the inner fabric 9 and the outer fabric 10 through the opening portion 7, the chemical warmer 8 can be attached in the position facing the back of the hand in the body portion 2.

The chemical warmer (so-called disposable warmer) 8 is not specifically limited and may be any of known chemical warmers, for example, an article in which an exothermic composition containing an oxidizable metal, such as iron powder, is contained in a breathable housing. The exothermic composition may contain, for example, a metal powder such as iron powder, activated carbon, water, and water-retaining agents (such as wood powder, vermiculite, silica clay, perlite, silica gel, alumina, and water-absorbent resin). Examples of the material forming the housing include nonwoven fabrics, woven fabrics, and knitted fabrics.

The size and shape of the chemical warmer 8 are not specifically limited and may be selected appropriately according to the size, shape, and the like of the opening portion 7. The chemical warmer 8 may have a size of, for example, about 6 to 15 cm in length and about 4 to 12 cm in width. The shape of the chemical warmer 8 may be, for example, a rectangular shape, a circular shape, an oval shape, a semicircular shape, or a heart shape. The thickness of the chemical warmer 8 is also not specifically limited and may be selected appropriately in consideration of wearing comfort and the like. The chemical warmer 8 may have a thickness of, for example, about 0.5 to 1.5 cm.

As shown in FIGS. 1 to 4, the inner glove 1 of the present disclosure may include a tightening portion 12 joined to the body portion 2 to prevent the wrist side of the body portion 2 from curling up. The material forming the tightening portion 12 is not specifically limited as long as it has the function to tighten the wrist, and examples include woven fabrics, knitted fabrics, and nonwoven fabrics with high stretchability, with a rib-knitted fabric being preferred. While the length (axial direction) of the tightening portion 12 is not specifically limited, it is typically about 1 to 5 cm, and preferably 2 to 4 cm.

EXAMPLES

The inner glove of the present disclosure will be specifically described below with examples; however, the present disclosure is not limited to these examples.

Example 1

A circular knitting machine was used to produce a tubular seamless fabric using a covered yarn containing a polyurethane elastic yarn as a core yarn and a polyamide yarn as a sheath yarn (polyamide yarn: 93% by weight, polyurethane elastic yarn: 7% by weight). A tubular two-layer structure formed of an inner fabric 9 and an outer fabric 10 was obtained by folding the thus-produced tubular seamless fabric in the axial direction. An opening 4 in which a thumb is inserted, and an opening portion 7 allowing insertion and removal of a chemical warmer, which is formed in the outer fabric 10, were formed during knitting of the tubular seamless fabric. Then, a joint portion 6 was formed by sewing the back-side fabric and the palm-side fabric of the tubular two-layer structure to form an opening 5*a* in which an index finger and a middle finger are inserted and an opening 5*b* in which a ring finger and a little finger are inserted. Additionally, a connection portion 11 was formed by sewing the inner fabric 9 and the outer fabric 10 on the wrist side of the tubular two-layer structure. A body portion 2 as shown in FIG. 1 was produced using the method as described above. The body portion 2 was about 15.5 cm in length and about 9 cm in width when placed flat. The opening portion 7 was formed in a central section of the body portion 2 and had an oval shape, with the oval having a major diameter of about 2.5 cm. Then, a tightening portion 12 (length: about 3 cm) formed of a tubular seamless rib-knitted fabric was sewn to a wrist-side end of the body portion 2. An inner glove 1 as shown in FIG. 1 was produced using the method as described above.

The inner glove 1 obtained was seamless in a circumferential direction of the hand and free of sewn seams, and thus achieved excellent wearing comfort. Moreover, in the inner glove 1, by inserting a chemical warmer 8 (length: about 9 cm, width: about 5 cm, thickness: about 1 cm) between the inner fabric 9 and the outer fabric 10 through the opening portion 7, the chemical warmer 8 was easily attached in the position facing the back of the hand in the body portion 2. Furthermore, the inner glove 1 achieved a good fit regardless of hand size, as well as a tightening effect, which prevented the chemical warmer 8 from moving out of position due to hand movements, allowing the chemical warmer 8 to be held in the position facing the back of the hand.

(Measurement of Elongation of Body Portion)

The elongation of the body portion 2 of the inner glove 1 produced in Example 1 was measured using the following method. A sample was obtained first by cutting the outer fabric into a ring shape with a width of 2 cm (axial direction), in a region at least 2 cm toward the inner side from both ends of the body portion 2 and not having the opening 4 in which the thumb is inserted and the opening portion 7 allowing insertion and removal of the chemical warmer. The sample was placed flat, and maximum length $L_0$ of the sample was measured with a ruler. Then, one end of the ring-shaped sample was hooked on a suspended S-hook, with a 50 g weight suspended on the other end of the ring-shaped sample, and maximum length Li of the sample after elongation was measured with a ruler. Then, the elongation was calculated using the following equation. The body portion 2 of the inner glove 1 produced in Example 1 had an elongation of 15%.

$$\text{Elongation (\%)} = \{(L_1 - L_0)/L_0\} \times 100$$

REFERENCE SIGNS LIST

1: inner glove
2: body portion
3: opening in which a wrist is inserted
4: opening in which a thumb is inserted
5: openings in which fingers other than the thumb are inserted
5*a*: opening in which an index finger and a middle finger are inserted
5*b*: opening in which a ring finger and a little finger are inserted
5*c*: opening in which an index finger is inserted
5*d*: opening in which a middle finger is inserted
5*e*: opening in which a ring finger is inserted
5*f*: opening in which a little finger is inserted
6: joint portion
7: opening portion allowing insertion and removal of a chemical warmer
8: chemical warmer
9: inner fabric
10: outer fabric
11: connection portion
12: tightening portion

What is claimed is:

1. An inner glove for wearing under an outer glove, wherein the inner glove comprises a body portion that is seamless in a circumferential direction of a hand, and wherein the body portion is longitudinally divided into three sections of equal length, including a wrist-side section, a central section, and a finger-side section, wherein the body portion comprises an opening for a wrist to be inserted, an opening for a thumb to be inserted, and at least two openings for fingers other than the thumb to be inserted, wherein a joint portion is formed in the finger-side section to join a back-of-hand side of the inner glove and a palm-side of the inner glove to form the at least two openings for the fingers other than the thumb, wherein the joint portion serves as a stopper to maintain the central section at the back of the hand by preventing the central section of the body portion from being inserted unnecessarily to the wrist side of the hand when the inner glove is worn on a hand, wherein the body portion has a multilayer structure including an inner fabric and an outer fabric, wherein a thickness of the multilayer structure is about 0.3 to 1.3 mm so that the inner glove is thin and can follow changes in a shape of the hand, wherein the inner glove is configured to match and be used in combination with the outer glove, wherein the inner fabric and the outer fabric are made of a stretchable material, wherein the stretchable material is a covered yarn containing a polyurethane elastic yarn as a core yarn and a polyamide yarn as a sheath yarn, wherein when a total content of the polyurethane elastic yarn and the polyamide yarn is defined as 100% by weight, a content of the polyamide yarn is 90 to 95% by weight and a content of the polyurethane elastic yarn is 5 to 10% by weight, wherein the outer fabric comprises an opening portion allowing insertion and removal of a chemical warmer, wherein the opening portion is located in the central section of the body portion in a position facing the back of the hand, and wherein the body portion has an elongation of 15 to 30% and is configured such that the chemical warmer is attachable in the position facing the back of the hand, between the inner fabric and the outer fabric.

2. The inner glove according to claim 1, wherein the body portion includes two openings for fingers other than the thumb to be inserted.

3. The inner glove according to claim 2, wherein the two openings for fingers other than the thumb to be inserted are an opening for an index finger and a middle finger to be inserted and an opening for a ring finger and a little finger to be inserted.

4. The inner glove according to claim 1, wherein the body portion includes four openings for fingers other than the thumb to be inserted.

5. The inner glove according to claim 1, wherein the body portion includes two openings for thumbs to be inserted, and the inner glove is an inner glove for left and right hands.

6. The inner glove according to claim 1, wherein the body portion has a two-layer structure formed of the inner fabric and the outer fabric.

7. The inner glove according to claim 1, further comprising a resiliently stretchable cuff joined to the body portion, wherein the resiliently stretchable cuff is configured to hold and prevent a wrist side of the body portion from curling up.

* * * * *